United States Patent [19]

Holtermann

[11] 3,955,527

[45] May 11, 1976

[54] MARINE PROPULSION TRIM TAB WITH ANTI VENTILATION MEANS

[75] Inventor: Theodore J. Holtermann, Milwaukee, Wis.

[73] Assignee: Outboard Marine Corporation, Waukegan, Ill.

[22] Filed: July 8, 1974

[21] Appl. No.: 486,318

[52] U.S. Cl. ..... 115/35; 115/17; 115/34 R

[51] Int. Cl.[2] ..... B63H 1/28

[58] Field of Search ..... 115/34 R, 35, 17, 18 R, 115/18 B, 145 R, 145 A

[56] References Cited

UNITED STATES PATENTS

| | | | |
|---|---|---|---|
| 1,716,962 | 6/1929 | Johnson | 115/18 R |
| 1,980,685 | 11/1934 | Johnson | 115/35 |
| 2,256,831 | 9/1941 | Karey | 115/18 R |
| 2,998,795 | 9/1961 | Downie et al. | 114/145 A |
| 3,516,378 | 6/1970 | Linsley | 115/18 B |
| 3,537,419 | 11/1970 | Holtermann et al. | 115/34 R |

*Primary Examiner*—Trygve M. Blix
*Assistant Examiner*—Edward R. Kazenske
*Attorney, Agent, or Firm*—Michael, Best & Friedrich

[57] ABSTRACT

Disclosed herein is a marine propulsion device including a lower unit comprising a laterally extending anti-cavitation plate extending from the lower unit above a propeller and including a trailing portion, together with a trim tab extending downwardly from the trailing portion of the anti-cavitation plate aft of the propeller, and a deflector located aft of the propeller and extending from the trailing portion of the anti-cavitation plate and rearwardly of the trim tab for pressurizing the water forwardly thereof and below the anti-cavitation plate and in the region of the trim tab during forward movement of the lower unit through the water.

10 Claims, 9 Drawing Figures

MARINE PROPULSION TRIM TAB WITH ANTI VENTILATION MEANS

BACKGROUND OF THE INVENTION

The invention relates generally to marine propulsion devices such as stern drive units and outboard motors, and more particularly to such marine propulsion devices with trim tabs or exhaust snouts.

Trim tabs have been employed for some time in stern drive units to counter "steering torque", i.e., the tendency of a drive shaft housing to rotate due to the torque applied to the drive shaft, and thus, to cause an undesired steering effect. Trim tabs have concurrently served as exhaust gas discharge snouts and have also been employed with so-called "through-the-propeller-hub" exhaust gas discharge systems.

Examples of prior trim tab construction are disclosed in the U.S. Shimanckas Pat. No. 3,000,183, issued May 19, 1965, and in the U.S. Pat. No. 3,537,419, to Holtermann issued Nov. 3, 1970.

Another prior trim tab construction is disclosed in the Canadian Pat. No. 687,868, to Kiekhaefer issued June 2, 1964.

Still another prior trim tab construction is disclosed in the U.S. Pat. application Ser. No. 26,234, to Granholm filed June 26, 1972.

The amount of counteraction to the "steering torque" developed by a trim tab can vary depending upon the pressure distribution produced by the water flowing past the trim tab. The pressure acting on a portion of the trim tab may be below atmospheric pressure. If air leaks or migrates into this low pressure area and "ventilates" it, the pressure is raised and the effectiveness of the trim tab in counteracting steering torque is reduced.

RELATED INVENTION

Attention is directed to my co-pending application Ser. No. 376,408 filed July 5, 1973, now U.S. Pat. No. 3,817,202 and entitled "Anti-Ventilation Fence for a Trim Tab".

SUMMARY OF THE INVENTION

The invention provides a marine propulsion device including a lower unit having a laterally extending anti-cavitation plate extending from the lower unit above a propeller and including a trailing portion, together with a trim tab extending downwardly from the trailing portion of the anti-cavation plate aft of the propeller, and a deflector located aft of the propeller and extending from the trailing portion of the anti-cavitation plate and rearwardly of the trim tab for pressurizing the water forwardly thereof and below the anticavitation plate and in the region of the trim tab during forward movement of the lower unit through the water.

As referred to hereinafter, various deflector constructions can be employed in combination with various anti-cavitation plate trailing edge configurations.

As a result of the employment of a deflector as disclosed herein, a relatively high pressure area is created at the trailing edge of the anti-cavitation plate. This forestalls the passage of air into the area of the trim tab and thereby maintains trim tab effectiveness in counteracting stern drive steering torque.

One of the principal features of the invention is the provision in a marine propulsion device of a deflector extending downwardly from an anti-cavitation plate in a position so as to pressurize the water flowing thereby and so as thereby to prevent or at least reduce ventilation from the top of a trim tab extending downwardly from the anti-cavitation plate.

Other features and advantages of the invention will become known by reference to the following general description, claims, and appended drawings.

THE DRAWINGS

Figure 1:
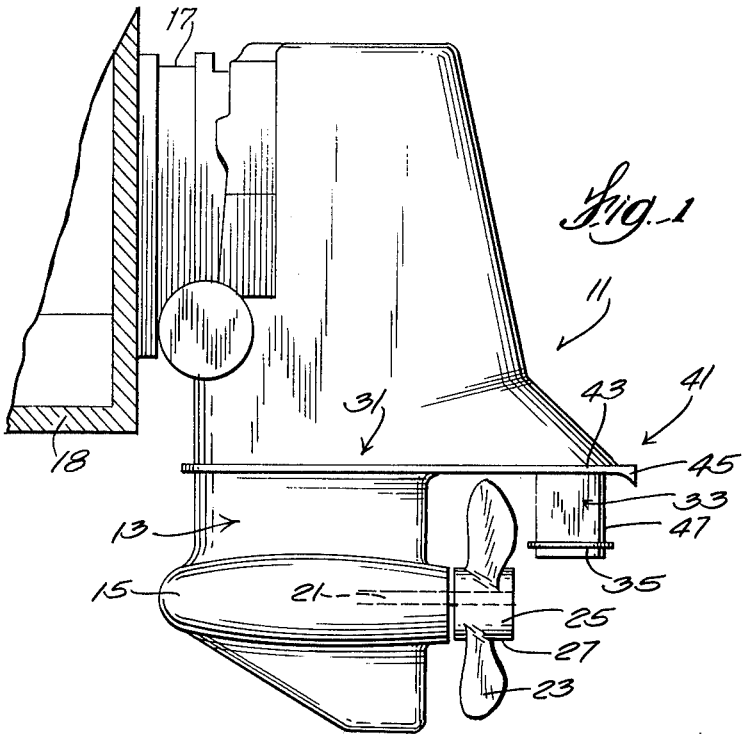
FIG. 1 is a fragmentary side elevational view of a marine propulsion device embodying various of the features of the invention.

Before explaining the invention in detail, it is to be understood that the invention is not limited in its application to the details of the construction and the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

GENERAL DESCRIPTION

Shown fragmentarily in the drawings is a stern drive unit 11 comprising a lower unit 13 including a gear box 15 normally submerged in water. The lower unit 13 is connected to any suitable means 17 adapted for attachment to a boat hull 18 so as to afford steering movement of the lower unit 13 relative to the boat hull and preferably also to afford vertical swinging movement of the lower unit 13 relative to the boat hull.

Rotatably mounted in the gear box 15 is a propeller shaft 21 which is rotatable by an engine (not shown) and which supports a propeller 23 for common rotation therewith. The engine exhaust gas can be discharged under water through a passage 25 within the propeller hub 27.

Extending laterally from the lower unit 13 above the gear box 15 and above the propeller 23 is an anti-cavitation plate 31 adapted to restrain the downward flow of air along the sides of the lower unit 13 and thereby retain the water beneath the anti-cavitation plate 31 in "solid" condition.

Extending downwardly from the lower unit 13 below the anti-cavitation plate and aft of the propeller 23 is a trim tab 33 which can be employed for underwater discharge of exhaust gases from the engine. As thus far disclosed, the construction is conventional.

Trim tab 33 can include a barrier 35 for preventing upward migration of exhaust gases discharged into the water as disclosed in my earlier application Ser. No. 376,408 filed July 5, 1973, now U.S. Pat. No. 3,817,202, and incorporated herein by reference.

In accordance with the invention, means 41 are provided for deflecting downwardly water passing rearwardly of the anti-cavitation plate 31 to thereby pressurize the water at the top of and just behind the trim tab 33. In particular, the deflector means 41 serves to reduce or prevent ventilation of the trim tab 33 from the area of the rearward or trailing portion 43 of the anti-cavitation plate 31 and particularly from the trailing edge 45 of the anti-cavitation plate 31. In this regard, the deflector means extends downwardly from the rearward portion 43 of the anti-cavitation plate 31 and preferably rearwardly of the rearward end or edge 47 of the trim tab 33 and terminates, as shown in FIG. 1, with a lowermost surface or edge well above the propeller shaft 21.

Figure 2:
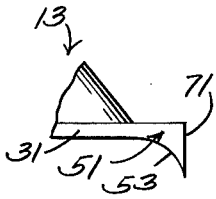
FIG. 2 is an enlarged fragmentary view of a portion of the marine propulsion device shown in FIG. 1.
Figure 3:
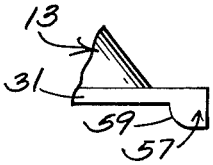
FIG. 3 is an enlarged fragmentary view similar to FIG. 2 showing a modified deflector construction.
Figure 4:
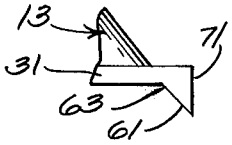
FIG. 4 is a view similar to FIG. 3 showing still another modified deflector construction.
Figure 5:
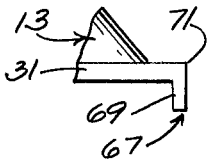
FIG. 5 is a view similar to FIG. 3 showing still another modified deflector construction.

Various constructions can be employed for the deflector means 41. In the construction shown in FIGS. 1 and 2, the deflector means comprises a deflector 51 including a forwardly facing surface 53 which is forwardly and downwardly concave. In the construction shown in FIG. 3, the deflector means comprises a deflector 57 including a forwardly facing surface 59 which is forwardly and downwardly convex. In the construction shown in FIG. 4, the deflector means comprises a deflector 61 including a forwardly facing surface 63 which, in the fore and aft section, is straight and which extends rearwardly and downwardly. In the construction shown in FIG. 5, the deflector means comprises a deflector 67 including a forwardly facing surface 69 which is generally vertical.

Figure 6:
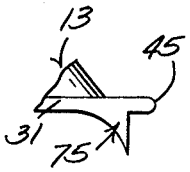
FIG. 6 is a view similar to FIG. 3 showing still another modified deflector construction.

The rearwardly facing surfaces 71 of the deflectors 51, 57, 61 and 67 can take any desired configuration. In the embodiments shown in FIGS. 2, 3, 4 and 5, the rearwardly facing surfaces 71 of the deflectors 51, 57, 61 and 67 can be generally co-terminus with the rearward or trailing edge 45 of the anti-cavitation plate 31. If desired, as shown in FIG. 6, the trailing edge 45 of the anti-cavitation plate 31 can extend rearwardly of a deflector 75 which can be similar in construction to any of the deflectors 51, 57, 61 and 67. Alternatively expressed, the deflector 75 can extend downwardly from the anti-cavitation plate 31 in forwardly spaced relation from the rearward edge 45 of the anti-cavitation plate 31. Various anti-cavitation plate constructions can be employed. In the constructions shown in FIGS. 1 and 7, the rearward edge of the anti-cavitation plate 31 is straight and extends transversely of the direction of intended lower unit travel. In the construction shown in FIG. 8, the rearward edge 93 of an anti-cavitation plate 83 includes two angularly related edge portions 97 and 99 merging at a rearwardly located junction 100. If desired, the angularly related edge portions could merge at a forwardly located junction. In the construction shown in FIG. 9, the rearward edge 95 of an anticavitation plate 85 is rearwardly convex. If desired the rearward edge of the anti-cavitation plate can be rearwardly concave and the deflector can be similiarly rearwardly concave.

Figure 7:
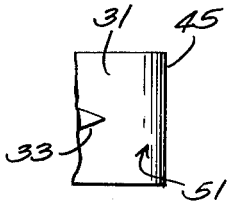
FIG. 7 is a fragmentary bottom plan view of a portion of the marine propulsion device shown in FIG. 1.
Figure 8:
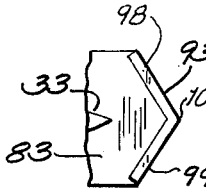
FIG. 8 is a fragmentary bottom plan view similar to FIG. 7 showing a modified anti-cavitation plate construction.
Figure 9:
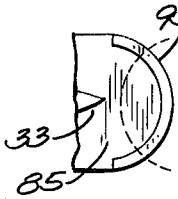
FIG. 9 is a view similar to FIG. 8 showing still another modified anti-cavitation plate construction.

As shown in FIGS. 7, 8 and 9 the width of the trim tab 33 is substantially less than the width of the adjacent part of the associated anti-cavitation plate, and less than the width of the associated deflector. Any of the deflectors 51, 57, 61, 67 and 75 shown in FIGS. 2 through 6 can be used with any of the anti-cavitation plates 31, 83 and 85 shown in FIGS. 7 through 9. Preferably, the deflectors 51, 57, 61, 67 and 75 have a width which extends for about the width of the adjacent part of the associated anti-cavitation plates 31, 83 and 85. However, the deflectors 51, 57, 61, 67 and 75 can have a width which is narrower than the adjacent part of the associated anti-cavitation plates 31, 83 and 85. In addition, the anti-cavitation plates 31, 83 and 85 can integrally include the deflectors 51, 57, 61, 67 and 75 and the deflector can be provided by downward bending of the rear of the anti-cavitaion plate.

In operation, water moving rearwardly relative to the lower unit and beneath the anti-cavitation plate encounters the deflector which produces a positive pressure field in the water in the area at the top of and just behind the trim tab 33 to thereby prevent trim tab ventilation.

Various of the features of the invention are set forth in the following claims:

What is claimed is:

1. A marine propulsion device including a propulsion unit comprising means adapted to be connected to a boat hull for mounting said propulsion unit from the boat hull for steering movement relative to the boat hull, and a lower unit including a gear box normally submerged in water, a propeller shaft rotatably mounted by said lower unit gear box and carrying a propeller, a laterally extending anti-cavitation plate extending above said propeller and including a trailing portion, a trim tab extending downwardly from said trailing portion of said anti-cavitation plate aft of said propeller, and deflector means fixedly located aft of said propeller and solely extending downwardly from said trailing portion of said anti-cavitation plate and rearwardly of said trim tab for pressurizing the water forwardly thereof and below said anti-cavitation plate and in the region of said trim tab during forward movement of said gear box through the water, said deflector means having a lowermost surface above said propeller shaft.

2. A marine propulsion device in accordance with claim 1 wherein said deflector means includes a forward surface which is concave.

3. A marine propulsion device in accordance with claim 1 wherein said deflector means includes a forward surface which in convex.

4. A marine propulsion device in accordance with claim 1 wherein said deflector means includes a forwardly located surface extending downwardly from said anti-cavitation plate.

5. A marine propulsion device in accordance with claim 1 wherein said deflector means includes a forwardly located surface extending downwardly and rearwardly from said anti-cavitation plate.

6. A marine propulsion device in accordance with claim 1 wherein said trailing portion of said anti-cavitation plate includes a straight trailing edge which extends transversely of the direction of travel of said lower unit.

7. A marine propulsion device in accordance with claim 1 wherein said trailing portion of said anti-cavitation plate includes a pair of angularly related trailing edge portions extending from a rearwardly located junction.

8. A marine propulsion device in accordance with claim 1 wherein said trailing portion of said anti-cavitation plates includes a trailing edge which is rearwardly convex.

9. A marine propulsion device in accordance with claim 1 wherein said deflector means extends downwardly from said anti-cavitation plate forwardly of the trailing edge thereof.

10. A marine propulsion device in accordance with claim 1 wherein said deflector means has a width greater than said trim tab and extends laterally outwardly beyond the sides of said trim tab.

* * * * *